US008593366B2

(12) United States Patent
Wakabayashi

(10) Patent No.: US 8,593,366 B2
(45) Date of Patent: Nov. 26, 2013

(54) MULTI-ANTENNA APPARATUS AND MOBILE DEVICE

(75) Inventor: Naoyuki Wakabayashi, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 426 days.

(21) Appl. No.: 12/949,994

(22) Filed: Nov. 19, 2010

(65) Prior Publication Data

US 2011/0122040 A1 May 26, 2011

(30) Foreign Application Priority Data

Nov. 20, 2009 (JP) ..... 2009-264448

(51) Int. Cl.
*H01Q 21/00* (2006.01)
*H01Q 19/00* (2006.01)

(52) U.S. Cl.
USPC ..... 343/835; 343/833; 343/834

(58) Field of Classification Search
USPC ..... 343/700 MS, 810, 815, 833, 834, 835
See application file for complete search history.

(56) References Cited

U.S. PATENT DOCUMENTS

| | | | | |
|---|---|---|---|---|
| 6,069,586 | A * | 5/2000 | Karlsson et al. | 343/700 MS |
| 7,352,328 | B2 | 4/2008 | Moon et al. | |
| 7,525,502 | B2 * | 4/2009 | Hui et al. | 343/835 |
| 7,557,761 | B2 | 7/2009 | Iwai et al. | |
| 7,688,273 | B2 | 3/2010 | Montgomery et al. | |
| 7,688,275 | B2 | 3/2010 | Montgomery et al. | |
| 2006/0038736 | A1 | 2/2006 | Hui et al. | |
| 2010/0265146 | A1 | 10/2010 | Montgomery et al. | |

FOREIGN PATENT DOCUMENTS

| | | | |
|---|---|---|---|
| EP | 0 958 636 | B1 | 4/2006 |
| GB | 2 458 492 | A | 9/2009 |
| JP | 2004-274445 | A | 9/2004 |
| JP | 2006-108830 | A | 4/2006 |
| JP | 2007-97167 | A | 4/2007 |
| JP | 2008-17047 | A | 1/2008 |
| JP | 2008-199588 | A | 8/2008 |
| JP | 2008-245132 | A | 10/2008 |
| JP | 2009-521898 | A | 6/2009 |
| JP | 2009-246560 | A | 10/2009 |

OTHER PUBLICATIONS

European Search Report dated Mar. 3, 2011(seven (7) pages).
European Examination Report dated Mar. 27, 2013 (five (5) pages).

* cited by examiner

*Primary Examiner* — Hoang V Nguyen
(74) *Attorney, Agent, or Firm* — Crowell & Moring LLP

(57) ABSTRACT

This multi-antenna apparatus includes a first antenna element and a second antenna element, and an ungrounded passive antenna element arranged between the first antenna element and the second antenna element, wherein the passive antenna element has a first opposing portion opposed to the first antenna element, a second opposing portion opposed to the second antenna element and a coupling portion coupling the first opposing portion and the second opposing portion with each other.

18 Claims, 6 Drawing Sheets

MULTI-ANTENNA APPARATUS AND MOBILE DEVICE

BACKGROUND OF THE INVENTION

1. Field of the Invention

The present invention relates to a multi-antenna apparatus and a mobile device, and more particularly, it relates to a multi-antenna apparatus and a mobile device each comprising a plurality of antenna elements.

2. Description of the Background Art

A multi-antenna apparatus comprising a plurality of antenna elements is known in general, as disclosed in Japanese Patent Laying-Open No. 2007-97167, for example.

The aforementioned Japanese Patent Laying-Open No. 2007-97167 discloses a MIMO array antenna (multi-antenna apparatus) comprising two antenna elements spaced apart a distance of one half of a wavelength λ of the corresponding radio wave from each other and a substantially U-shaped isolation element (passive antenna element) arranged between the two antenna elements for inhibiting a mutual coupling between the two antenna elements. This isolation element has an electrical length of about λ and is partially grounded on a ground surface. The isolation element is arranged at a position separated from each of the two antenna elements by a distance of about λ/4.

In the MIMO array antenna according to the aforementioned Japanese Patent Laying-Open No. 2007-97167, however, the isolation element must be grounded on the ground surface although the mutual coupling between the antenna elements can be inhibited by providing the isolation element (passive antenna element). Therefore, flexibility of wiring pattern design is disadvantageously reduced.

SUMMARY OF THE INVENTION

The present invention has been proposed in order to solve the aforementioned problems, and an object of the present invention is to provide a multi-antenna apparatus and a mobile device each capable of reducing a mutual coupling between antenna elements while inhibiting reduction of flexibility of wiring pattern design.

A multi-antenna apparatus according to a first aspect of the present invention comprises a first antenna element and a second antenna element, and an ungrounded passive antenna element arranged between the first antenna element and the second antenna element, wherein the passive antenna element includes a first opposing portion opposed to the first antenna element, a second opposing portion opposed to the second antenna element and a coupling portion coupling the first opposing portion and the second opposing portion with each other.

As hereinabove described, the multi-antenna apparatus according to the first aspect of the present invention is provided with the passive antenna element including the first opposing portion opposed to the first antenna element, the second opposing portion opposed to the second antenna element and the coupling portion coupling the first opposing portion and the second opposing portion with each other, whereby a direct coupling not through the passive antenna element and an indirect coupling through the passive antenna element can be formed between the first antenna element and the second antenna element. In other words, when a current flows in the first antenna element, a current flowing in the second antenna element by the direct coupling to the first antenna element and a current flowing in the second antenna element through the first opposing portion, the coupling portion and the second opposing portion of the passive antenna element by the indirect coupling to the first antenna element are generated. In this case, a direction of the current flowing in the second antenna element due to the direct coupling to the first antenna element and a direction of the current flowing in the second antenna element due to the indirect coupling to the first antenna element by the current in the second opposing portion of the passive antenna element can be rendered opposite to each other if the passive antenna element (the first opposing portion of the passive antenna element) is so arranged that a direction of a current flowing in the first antenna element and a direction of a current flowing in the second opposing portion of the passive antenna element is opposite to each other. Thus, the current due to the direct coupling and the current due to the indirect coupling are offset by each other, and hence a mutual coupling between the first antenna element and the second antenna element can be reduced. Further, the passive antenna element is rendered ungrounded, whereby it is not necessary to ground the passive antenna element on a prescribed ground surface, and hence reduction of flexibility of wiring pattern design can be inhibited. Therefore, in this multi-antenna apparatus, the mutual coupling between the antenna elements can be reduced while inhibiting reduction of flexibility of wiring pattern design. The mutual coupling between the antenna elements can be reduced, and hence it is not necessary to increase a distance between the antenna elements to reduce the mutual coupling between the antenna elements, and the multi-antenna apparatus can be downsized accordingly.

In the aforementioned multi-antenna apparatus according to the first aspect, the coupling portion of the passive antenna element is preferably formed to couple the first opposing portion and the second opposing portion with each other such that currents in opposite directions flow in the first opposing portion and the second opposing portion. According to this structure, a direction of a current flowing in the first opposing portion of the passive antenna element due to a coupling to the first antenna element and the direction of the current flowing in the second opposing portion through the coupling portion is opposite to each other, and hence the direction of the current flowing in the first antenna element and the direction of the current flowing in the second opposing portion can be easily rendered opposite to each other.

In the aforementioned multi-antenna apparatus according to the first aspect, the first opposing portion and the second opposing portion of the passive antenna element are preferably spaced apart distances enabling electrostatic couplings to the first antenna element and the second antenna element therefrom, respectively. According to this structure, the first opposing portion and the second opposing portion can be arranged at closer distances from the first antenna element and the second antenna element respectively, and hence the multi-antenna apparatus can be downsized as compared with a case of an electromagnetic coupling.

In the aforementioned multi-antenna apparatus according to the first aspect, the passive antenna element is preferably formed to resonate due to currents flowing in the first antenna element and the second antenna element. According to this structure, energy conversion efficiency becomes maximum, and hence the mutual coupling between the first antenna element and the second antenna element can be efficiently reduced.

In this case, the passive antenna element preferably has an electrical length of substantially one half of a wavelength λ of a radio wave output from each of the first antenna element and the second antenna element. According to this structure, the ungrounded passive antenna element can easily resonate.

In the aforementioned multi-antenna apparatus according to the first aspect, the first antenna element is preferably so arranged that a minimum separate distance from the second antenna element is less than a quarter of a wavelength λ of a radio wave output from each of the first antenna element and the second antenna element. According to this structure, an interval between the first antenna element and the second antenna element is reduced, and hence the small-sized multi-antenna apparatus can be provided.

In this case, the aforementioned multi-antenna apparatus according to the first aspect preferably further comprises a first feeding point for supplying high-frequency power to the first antenna element, and a second feeding point for supplying high-frequency power to the second antenna element, wherein the first antenna element and the second antenna element are so arranged that a distance therebetween is minimum between the first feeding point and the second feeding point. According to this structure, an interval between the first feeding point and the second feeding point is reduced, and hence the multi-antenna apparatus can be easily downsized.

The aforementioned multi-antenna apparatus according to the first aspect preferably further comprises a first feeding point for supplying high-frequency power to the first antenna element and a second feeding point for supplying high-frequency power to the second antenna element, a first matching circuit arranged between the first antenna element and the first feeding point for inhibiting a mutual coupling between the first antenna element and the second antenna element while matching impedance at a prescribed frequency of high-frequency power, and a second matching circuit arranged between the second antenna element and the second feeding point for inhibiting the mutual coupling between the first antenna element and the second antenna element while matching impedance at the prescribed frequency of high-frequency power. According to this structure, the mutual coupling between the antenna elements can be reduced while matching impedance at the prescribed frequency, and hence transfer loss of energy transferred through the antenna elements can be further reduced.

In the aforementioned structure in which the currents in the opposite directions flow in the first opposing portion and the second opposing portion, the passive antenna element is preferably formed in a substantially U shape by the first opposing portion, the second opposing portion and the coupling portion. According to this structure, the direction of the current flowing in the first opposing portion of the passive antenna element due to the coupling to the first antenna element and the direction of the current flowing in the second opposing portion through the coupling portion can be easily rendered opposite to each other by the simple-shaped passive antenna element.

In the aforementioned multi-antenna apparatus according to the first aspect, the first antenna element, the second antenna element, and the first opposing portion and the second opposing portion of the passive antenna element are preferably formed to be bent or curved at a plurality of positions. According to this structure, a length required to arrange the first antenna element, the second antenna element and the passive antenna element can be ensured due to bent or curved shapes thereof also when areas where the first antenna element, the second antenna element and the passive antenna element are arranged are small, and hence it is not necessary to enlarge the areas where the first antenna element, the second antenna element and the passive antenna element are arranged. Thus, the multi-antenna apparatus can be further downsized.

In the aforementioned multi-antenna apparatus according to the first aspect, the first antenna element and the second antenna element each preferably include a monopole antenna. According to this structure, the multi-antenna apparatus employing the monopole antennas can be downsized by reducing a mutual coupling between the monopole antennas.

In the aforementioned multi-antenna apparatus according to the first aspect, the first antenna element and the second antenna element each preferably include a dipole antenna. According to this structure, the multi-antenna apparatus employing the dipole antennas can be downsized by reducing a mutual coupling between the dipole antennas.

In the aforementioned multi-antenna apparatus according to the first aspect, the first antenna element, the second antenna element, and the first opposing portion and the second opposing portion of the passive antenna element are preferably arranged substantially parallel to each other. According to this structure, the multi-antenna apparatus can be downsized by a simple arrangement in which all of the first antenna element, the second antenna element, the first opposing portion and the second opposing portion of the passive antenna element are arranged substantially parallel to each other.

The aforementioned multi-antenna apparatus according to the first aspect preferably further comprises a first feeding point for supplying high-frequency power to the first antenna element, and a second feeding point for supplying high-frequency power to the second antenna element, wherein the passive antenna element is arranged between a straight line connecting a first end of the first antenna element on a side on which the first feeding point is arranged and a first end of the second antenna element on a side on which the second feeding point is arranged and a straight line connecting a second end of the first antenna element and a second end of the second antenna element. According to this structure, the passive antenna element does not protrude from a region between the first antenna element and the second antenna element, and hence the multi-antenna apparatus can be downsized.

The aforementioned multi-antenna apparatus according to the first aspect is preferably formed to be mountable on a mobile device. According to this structure, the small-sized multi-antenna apparatus mountable on the mobile device can be provided.

A mobile device according to a second aspect of the present invention comprises a multi-antenna apparatus including a first antenna element and a second antenna element, and an ungrounded passive antenna element arranged between the first antenna element and the second antenna element, wherein the passive antenna element has a first opposing portion opposed to the first antenna element, a second opposing portion opposed to the second antenna element and a coupling portion coupling the first opposing portion and the second opposing portion with each other.

As hereinabove described, the mobile device according to the second aspect of the present invention is provided with the passive antenna element including the first opposing portion opposed to the first antenna element, the second opposing portion opposed to the second antenna element and the coupling portion coupling the first opposing portion and the second opposing portion with each other, whereby a direct coupling not through the passive antenna element and an indirect coupling through the passive antenna element can be formed between the first antenna element and the second antenna element. In other words, when a current flows in the first antenna element, a current flowing in the second antenna element by the direct coupling to the first antenna element and a current flowing in the second antenna element through the first opposing portion, the coupling portion and the second opposing portion of the passive antenna element by the indirect coupling to the first antenna element are generated. In this case, a direction of the current flowing in the second antenna element due to the direct coupling to the first antenna element and a direction of the current flowing in the second antenna element due to the indirect coupling to the first antenna element by the current in the second opposing portion of the passive antenna element can be rendered opposite to each other if the passive antenna element (the first opposing portion of the passive antenna element) is so arranged that a direction of a current flowing in the first antenna element and a direction of a current flowing in the second opposing portion of the passive antenna element is opposite to each other. Thus, the current due to the direct coupling and the current due to the indirect coupling are offset by each other, and hence a mutual coupling between the first antenna element and the second antenna element can be reduced. Further, the passive antenna element is rendered ungrounded, whereby it is not necessary to ground the passive antenna element on a prescribed ground surface, and hence reduction of flexibility of wiring pattern design can be inhibited. Therefore, in this mobile device, the mutual coupling between the antenna elements can be reduced while inhibiting reduction of flexibility of wiring pattern design. The mutual coupling between the antenna elements can be reduced, and hence it is not necessary to increase a distance between the antenna elements to reduce the mutual coupling between the antenna elements, and the multi-antenna apparatus can be downsized accordingly. Consequently, the mobile device can be downsized.

In the aforementioned mobile device according to the second aspect, the coupling portion of the passive antenna element is preferably formed to couple the first opposing portion and the second opposing portion with each other such that currents in opposite directions flow in the first opposing portion and the second opposing portion. According to this structure, a direction of a current flowing in the first opposing portion of the passive antenna element due to a coupling to the first antenna element and the direction of the current flowing in the second opposing portion through the coupling portion is opposite to each other, and hence the direction of the current flowing in the first antenna element and the direction of the current flowing in the second opposing portion can be easily rendered opposite to each other.

In the aforementioned mobile device according to the second aspect, the first opposing portion and the second opposing portion of the passive antenna element are preferably spaced apart distances enabling electrostatic couplings to the first antenna element and the second antenna element therefrom, respectively. According to this structure, the first opposing portion and the second opposing portion can be arranged at closer distances from the first antenna element and the second antenna element respectively, and hence the multi-antenna apparatus can be further downsized as compared with a case of an electromagnetic coupling. Consequently, the mobile device can be further downsized.

In the aforementioned mobile device according to the second aspect, the passive antenna element preferably has an electrical length of substantially one half of a wavelength λ of a radio wave output from each of the first antenna element and the second antenna element. According to this structure, the ungrounded passive antenna element can easily resonate.

In the aforementioned mobile device according to the second aspect, the first antenna element is preferably so arranged that a minimum separate distance from the second antenna element is less than a quarter of a wavelength λ of a radio wave output from each of the first antenna element and the second antenna element. According to this structure, an interval between the first antenna element and the second antenna element is reduced, and hence the multi-antenna apparatus can be downsized. Consequently, the mobile device can be downsized.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention are now described with reference to the drawings.

First Embodiment

First, the structure of a mobile phone 100 according to a first embodiment of the present invention is described with reference to FIGS. 1 and 2. The mobile phone 100 is an example of the "mobile device" in the present invention.

Figure 1:
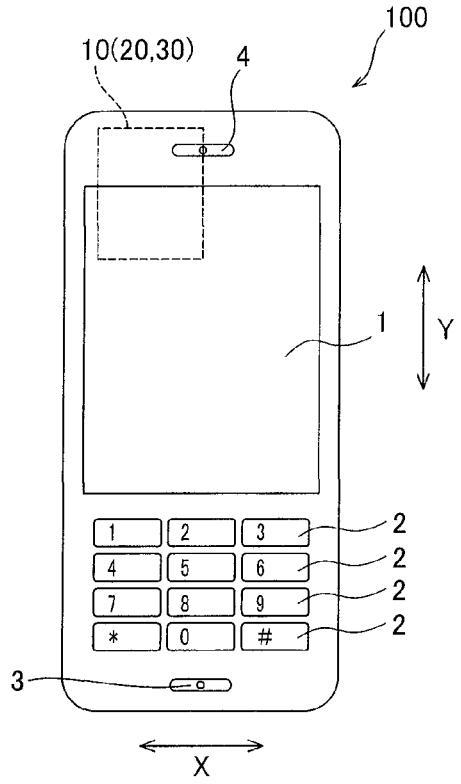
FIG. 1 is a plan view showing the overall structure of a mobile phone according to a first embodiment of the present invention.

The mobile phone 100 according to the first embodiment of the present invention has a substantially rectangular shape in front elevational view, as shown in FIG. 1. The mobile phone 100 comprises a display screen portion 1, operating portions 2 constituted by number buttons and so on, a microphone 3 and a speaker 4. A multi-antenna apparatus 10 is provided inside a housing of the mobile phone 100.

The multi-antenna apparatus 10 is formed for MIMO (Multiple-Input Multiple-Output) communication enabling multiple inputs/outputs at a prescribed frequency employing a plurality of antenna elements. The multi-antenna apparatus 10 corresponds to WiMAX (Worldwide Interoperability for Microwave Access), which is a high-speed wireless communication network of 2.5 GHz band.

Figure 2:
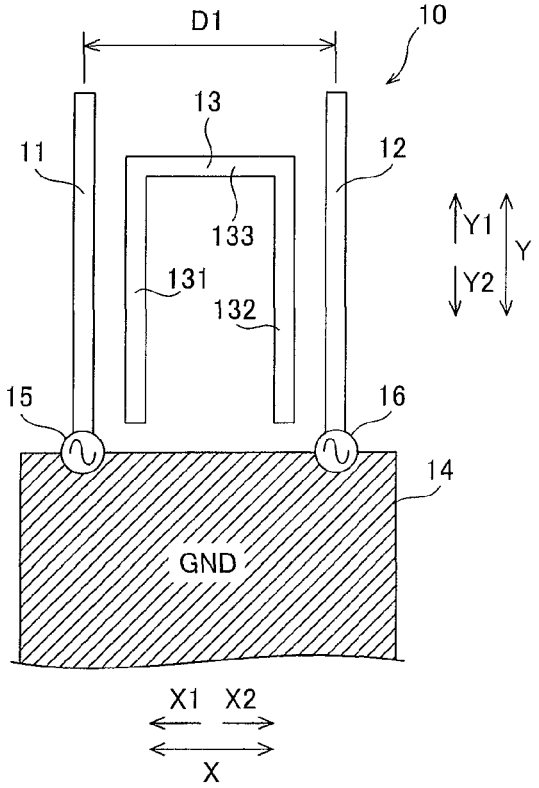
FIG. 2 is a plan view showing a multi-antenna apparatus of the mobile phone according to the first embodiment of the present invention.

The multi-antenna apparatus 10 includes a first antenna element 11 and a second antenna element 12, a passive antenna element 13 arranged between the two antenna elements 11 and 12, a ground surface 14, and a first feeding point 15 for supplying high-frequency power to the first antenna element 11 and a second feeding point 16 for supplying high-frequency power to the second antenna element 12, as shown in FIG. 2.

The first antenna element 11 is arranged on a side of the passive antenna element 13 in a direction X1, and the second antenna element 12 is arranged on a side of the passive antenna element 13 in a direction X2. The first antenna element 11 (second antenna element 12) has a thin plate shape and is provided on a surface of a substrate (not shown). The first antenna element 11 (second antenna element 12) is a monopole antenna having an electrical length of about a quarter of a wavelength λ of 2.6 GHz to which the multi-antenna apparatus 10 corresponds. More specifically, an end of the first antenna element 11 (second antenna element 12) in a direction Y1 is open, and an end thereof in a direction Y2 is grounded on the ground surface 14. The first antenna element 11 and the second antenna element 12 are formed to extend along arrow Y and arranged substantially parallel to each other. The first antenna element 11 is so arranged that a separate distance D1 from the second antenna element 12, which is a center-to-center distance, is less than λ/4. The electrical length is not a physical length but a length based on delay time of a signal.

The passive antenna element 13 has a first opposing portion 131 opposed to the first antenna element 11, a second opposing portion 132 opposed to the second antenna element 12 and a coupling portion 133 coupling the first opposing portion 131 and the second opposing portion 132 with each other. The passive antenna element 13 is so formed as to be in an ungrounded state of not being grounded on the ground surface 14. The passive antenna element 13 has an electrical length of about λ/2. The passive antenna element 13 is formed to resonate due to currents flowing in the first antenna element 11 and the second antenna element 12.

The first opposing portion 131 and the second opposing portion 132 are formed to extend along arrow Y and arranged substantially parallel to each other. In other words, the first antenna element 11, the first opposing portion 131, the second opposing portion 132 and the second antenna element 12 are arranged substantially parallel to each other. The passive antenna element 13 is arranged between a straight line connecting the ends of the first antenna element 11 and the second antenna element 12 in the direction Y1 and a straight line connecting the ends of the first antenna element 11 and the second antenna element 12 in the direction Y2. The first opposing portion 131 is spaced apart a distance enabling an electrostatic coupling to the first antenna element 11 therefrom. The second opposing portion 132 is spaced apart a distance enabling an electrostatic coupling to the second antenna element 12 therefrom. The coupling portion 133 couples ends of the first opposing portion 131 and the second opposing portion 132 in the direction Y1 with each other. The coupling portion 133 is formed to extend along arrow X. Thus, the passive antennal element 13 is formed in a substantially U shape by the first opposing portion 131, the second opposing portion 132 and the coupling portion 133. Thus, currents in opposite directions flow in the first opposing portion 131 and the second opposing portion 132.

The first feeding point 15 (second feeding point 16) is arranged on the ends of the first antenna element 11 (second antenna element 12) in the direction Y2. The first feeding point 15 (second feeding point 16) connects the first antenna element 11 (second antenna element 12) and a feeder (not shown) with each other.

According to the first embodiment, as hereinabove described, the passive antenna element 13 including the first opposing portion 131 opposed to the first antenna element 11, the second opposing portion 132 opposed to the second antenna element 12 and the coupling portion 133 coupling the first opposing portion 131 and the second opposing portion 132 with each other is provided, whereby a direct coupling not through the passive antenna element 13 and an indirect coupling through the passive antenna element 13 can be formed between the first antenna element 11 and the second antenna element 12. In other words, when a current flows in the first antenna element 11, a current flowing in the second antenna element 12 by the direct coupling to the first antenna element 11 and a current flowing in the second antenna element 12 through the first opposing portion 131, the coupling portion 133 and the second opposing portion 132 of the passive antenna element 13 by the indirect coupling to the first antenna element 11 are generated. In the structure according to the first embodiment of the present invention, the passive antenna element 13 is so arranged that a direction of a current flowing in the first antenna element 11 and a direction of a current flowing in the second opposing portion 132 of the passive antenna element 13 are opposite to each other, and hence a direction of the current flowing in the second antenna element 12 due to the direct coupling to the first antenna element 11 and a direction of the current flowing in the second antenna element 12 due to the indirect coupling to the first antenna element 11 by the current in the second opposing portion 132 of the passive antenna element 13 can be rendered opposite to each other. Thus, the current due to the direct coupling and the current due to the indirect coupling are offset by each other, and hence a mutual coupling between the first antenna element 11 and the second antenna element 12 can be reduced. Further, the passive antenna element 13 is rendered ungrounded, whereby it is not necessary to ground the passive antenna element 13 on the ground surface 14, and hence reduction of flexibility of wiring pattern design can be inhibited. Therefore, in this mobile phone 100, the mutual coupling between the antenna elements can be reduced while inhibiting reduction of flexibility of wiring pattern design. The mutual coupling between the antenna elements can be reduced, and hence it is not necessary to increase the distance between the antenna elements to reduce the mutual coupling between the antenna elements, and the multi-antenna apparatus 10 can be downsized accordingly. Consequently, the mobile phone 100 can be downsized.

According to the first embodiment, the first opposing portion 131 and the second opposing portion 132 of the passive antenna element 13 are spaced apart the distances enabling the electrostatic couplings to the first antenna element 11 and the second antenna element 12 therefrom, respectively, whereby the first opposing portion 131 and the second opposing portion 132 can be arranged at closer distances from the first antenna element 11 and the second antenna element 12 respectively, and hence the multi-antenna apparatus 10 can be downsized as compared with a case of an electromagnetic coupling.

According to the first embodiment, the passive antenna element 13 is formed to resonate due to the currents flowing in the first antenna element 11 and the second antenna element 12, whereby energy conversion efficiency becomes maximum, and hence the mutual coupling between the first antenna element 11 and the second antenna element 12 can be efficiently reduced.

According to the first embodiment, the passive antenna element 13 has an electrical length of substantially one half of a wavelength λ of a radio wave output from each of the first antenna element 11 and the second antenna element 12, so that the ungrounded passive antenna element 13 can easily resonate.

According to the first embodiment, the first antenna element 11 is so arranged that the minimum separate distance D1 from the second antenna element 12 is less than a quarter of the wavelength λ of the radio wave output from each of the first antenna element 11 and the second antenna element 12, whereby an interval between the first antenna element 11 and the second antenna element 12 is reduced, and hence the small-sized multi-antenna apparatus 10 can be provided.

According to the first embodiment, the first feeding point 15 for supplying high-frequency power to the first antenna element 11 and the second feeding point 16 for supplying high-frequency power to the second antenna element 12 are provided and the first antenna element 11 and the second antenna element 12 are so arranged that the distance therebetween is minimum between the first feeding point 15 and the second feeding point 16, whereby an interval between the first feeding point 15 and the second feeding point 16 is reduced, and hence the multi-antenna apparatus 10 can be easily downsized.

According to the first embodiment, the passive antenna element 13 is formed in a substantially U shape by the first opposing portion 131, the second opposing portion 132 and the coupling portion 133, whereby the direction of the current flowing in the first opposing portion 131 of the passive antenna element 13 due to a coupling to the first antenna element 11 and the direction of the current flowing in the second opposing portion 132 through the coupling portion 133 can be easily rendered opposite to each other by the simple-shaped passive antenna element 13.

According to the first embodiment, the first antenna element 11, the second antenna element 12, the first opposing portion 131 and the second opposing portion 132 of the passive antenna element 13 are arranged substantially parallel to each other, whereby the multi-antenna apparatus 10 can be downsized by a simple arrangement in which all of the first antenna element 11, the second antenna element 12, the first opposing portion 131 and the second opposing portion 132 of the passive antenna element 13 are arranged substantially parallel to each other.

According to the first embodiment, the multi-antenna apparatus 10 further comprises the first feeding point 15 for supplying high-frequency power to the first antenna element 11 and the second feeding point 16 for supplying high-frequency power to the second antenna element 12, and the passive antenna element 13 is arranged between a straight line connecting a first end of the first antenna element 11 where the first feeding point 15 is arranged and a first end of the second antenna element 12 where the second feeding point 16 is arranged and a straight line connecting a second end of the first antenna element 11 and a second end of the second antenna element 12. According to this structure, the passive antenna element 13 does not protrude from a region between the first antenna element 11 and the second antenna element 12, and hence the multi-antenna apparatus 10 can be downsized.

According to the first embodiment, the multi-antenna apparatus 10 is formed to be mountable on the mobile phone 100, whereby the small-sized multi-antenna apparatus 10 mountable on the mobile phone 100 can be provided.

Next, results of a simulation performed for confirming the aforementioned effects of the first embodiment are described. In this simulation, the multi-antenna apparatus 10 corresponding to the first embodiment shown in FIG. 2 and a multi-antenna apparatus 110 according to a comparative example shown in FIG. 3 have been compared with each other.

In the multi-antenna apparatus 10 corresponding to the first embodiment, the first antenna element 11 and the second antenna element 12 are so arranged that the separate distance D1 is 24 mm less than λ/4. While the antenna elements 11 and 12 and the passive antenna element 13 are provided on the surface of the substrate (not shown) in the aforementioned first embodiment, the antenna elements 11 and 12 and the passive antenna element 13 are provided in a vacuum in this simulation. In order to perform the simulation by a system corresponding to two dimensions, the antenna elements 11 and 12 and the passive antenna element 13 are formed of a conductor having a thickness of 0 mm.

Figure 3:
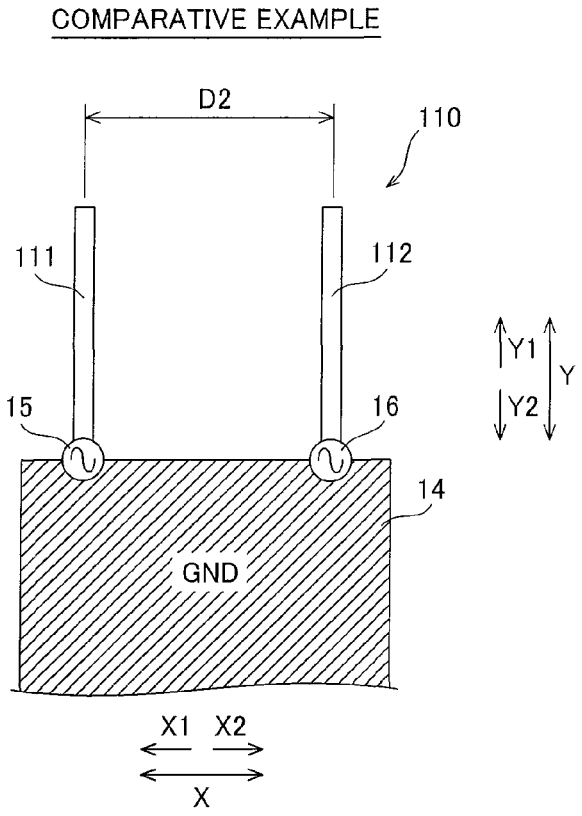
FIG. 3 is a plan view showing a multi-antenna apparatus according to a comparative example.

As shown in FIG. 3, in the multi-antenna apparatus 110 according to the comparative example, a passive antenna element is not provided between two antenna elements 111 and 112 dissimilarly to the multi-antenna apparatus 10 provided with the substantially U-shaped passive antenna element 13 according to the first embodiment. Further, in the multi-antenna apparatus 110 according to the comparative example, the antenna elements 111 and 112 are so arranged that a separate distance D2 therebetween, which is a center-to-center distance therebetween, is 24 mm. The remaining structure of the multi-antenna apparatus 110 according to the comparative example second embodiment is similar to that of the multi-antenna apparatus 10 corresponding to the aforementioned first embodiment.

Figure 4:
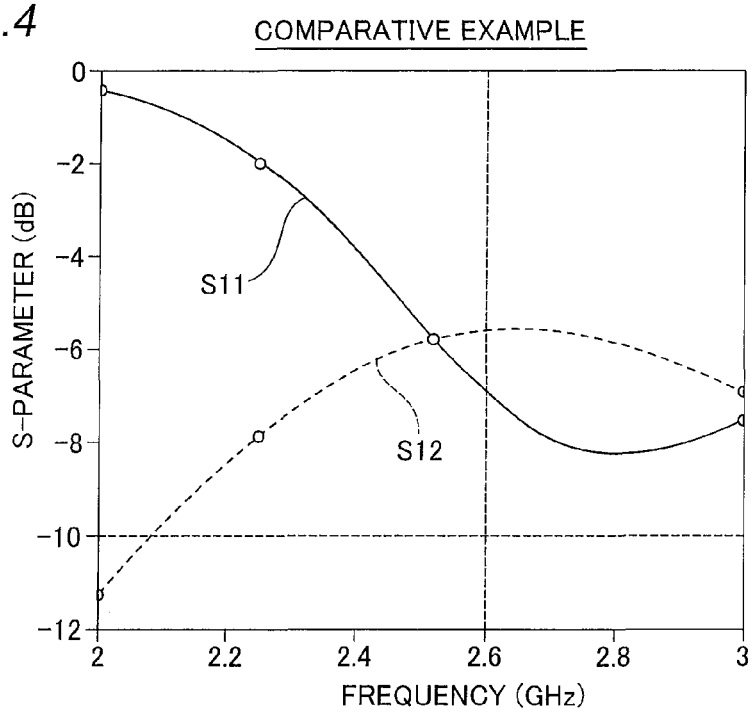
FIG. 4 is a diagram showing S-parameter characteristics of the multi-antenna apparatus according to the comparative example in a simulation.
Figure 5:
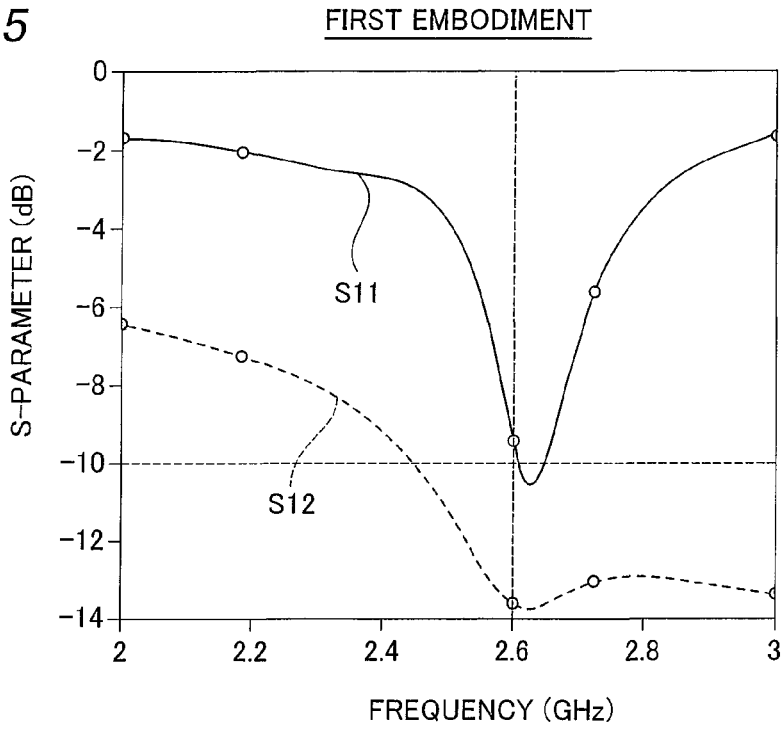
FIG. 5 is a diagram showing S-parameter characteristics of the multi-antenna apparatus corresponding to the first embodiment of the present invention in a simulation.

Next, S-parameter characteristics of the multi-antenna apparatus 110 according to the comparative example and the multi-antenna apparatus 10 corresponding to the first embodiment are described with reference to FIGS. 4 and 5. S11 of S-parameters shown in FIGS. 4 and 5 denotes reflection coefficients of an antenna element, and S12 of the S-parameters denotes strength of a mutual coupling between two antenna elements. In FIGS. 4 and 5, the axis of abscissas shows frequencies, and the axis of ordinates shows magnitude (unit: dB) of S11 and S12.

In the multi-antenna apparatus 110 according to the comparative example, as shown in FIG. 4, S11 is about −7 dB and S12 is about −5.8 dB at 2.6 GHz. On the other hand, in the multi-antenna apparatus 10 corresponding to the first embodiment, as shown in FIG. 5, S11 is about −9.5 dB and S12 is about −13.5 dB at 2.6 GHz to which the multi-antenna apparatus 10 corresponds. Consequently, S12 denoting strength (magnitude) of a mutual coupling between two antenna elements is smaller in the multi-antenna apparatus 10 corresponding to the first embodiment than in the multi-antenna apparatus 110 according to the comparative example, and hence it has been proved possible to reduce the mutual coupling between the antenna elements by providing the substantially U-shaped ungrounded passive antenna element 13. When S12 is not more than −10 dB, the mutual coupling between the antenna elements is conceivably fairly small.

This is conceivably for the following reason. In other words, a direct coupling due to the current flowing in the first antenna element 11 and an indirect coupling due to the current flowing in the second opposing portion 132 of the passive antenna element 13 are caused in the second antenna element 12 of the multi-antenna apparatus 10 corresponding to the first embodiment, and the currents due to the direct coupling and the indirect coupling are offset by each other, whereby the mutual coupling between the antenna elements is conceivably reduced.

S11 denoting reflection coefficients of an antenna element is smaller in the multi-antenna apparatus 10 corresponding to the first embodiment than in the multi-antenna apparatus 110 according to the comparative example, and hence it has been proved possible to output radio waves efficiently from the antenna elements by providing the substantially U-shaped ungrounded passive antenna element 13.

Second Embodiment

A multi-antenna apparatus 20 of a mobile phone 100 according to a second embodiment of the present invention is now described with reference to FIG. 6. In this second embodiment, the multi-antenna apparatus 20 in which a first antenna element 21, a second antenna element 22 and first and second opposing portions 231 and 232 of a passive antenna element 23 are formed to be bent at a plurality of positions is described, dissimilarly to the aforementioned first embodiment.

Figure 6:
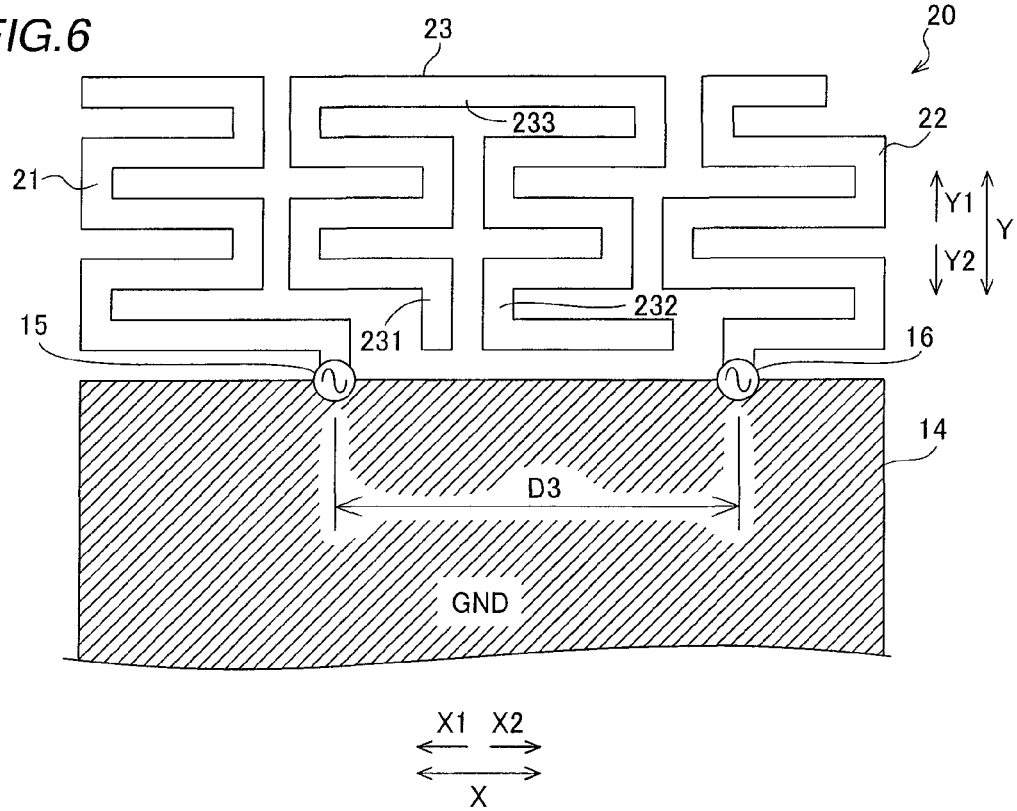
FIG. 6 is a plan view showing a multi-antenna apparatus of a mobile phone according to a second embodiment of the present invention.

As shown in FIG. 6, the multi-antenna apparatus 20 of the mobile phone 100 according to the second embodiment includes the first and second antenna elements 21 and 22, the passive antenna element 23 arranged between the two antenna elements 21 and 22, a ground surface 14, a first feeding point 15 for supplying high-frequency power to the first antenna element 21 and a second feeding point 16 for supplying high-frequency power to the second antenna element 22.

The first antenna element 21 is arranged on a side of the passive antenna element 23 in a direction X1, and the second antenna element 22 is arranged on a side of the passive antenna element 23 in a direction X2. The first antenna element 21 (second antenna element 22) has a thin plate shape and is provided on a surface of a substrate (not shown). Further, the first antenna element 21 (second antenna element 22) is a monopole antenna having an electrical length of about a quarter of a wavelength λ of 2.6 GHz to which the multi-antenna apparatus 20 corresponds. More specifically, an end of the first antenna element 21 (second antenna element 22) in a direction Y1 is open, and an end thereof in a direction Y2 is grounded on the ground surface 14.

According to the second embodiment, the first antenna element 21 and the second antenna element 22 are formed to be bent at the plurality of positions. The end of the first antenna element 21 in the direction Y1 is arranged at a position deviating in the direction X1 with respect to the end thereof in the direction Y2, and the end of the second antenna element 22 in the direction Y1 is arranged at a position deviating in the direction X2 with respect to the end thereof in the direction Y2, dissimilarly to the aforementioned first embodiment. The first antenna element 21 is so arranged that a separate distance D3 at the first feeding point 15 from the second antenna element 22 is less than λ/4. The first antenna element 21 and the second antenna element 22 are so arranged that the distance (D3) therebetween is minimum between the first feeding point 15 and the second feeding point 16.

The passive antenna element 23 has the first opposing portion 231 opposed to the first antenna element 21, the second opposing portion 232 opposed to the second antenna element 22 and a coupling portion 233 coupling the first opposing portion 231 and the second opposing portion 232 with each other. The passive antenna element 23 is so formed as to be in an ungrounded state of not being grounded on the ground surface 14. The passive antenna element 23 has an electrical length of about λ/2.

According to the second embodiment, the passive antenna element 23 has a substantially U shape as seen as a whole, whereas the first opposing portion 231 and the second opposing portion 232 of the passive antenna element 23 are formed to be bent at the plurality of positions. A separate distance between the first antenna element 21 and the first opposing portion 231 varies along arrow Y, and a separate distance between the second antenna element 22 and the second opposing portion 232 varies along arrow Y. The passive antenna element 23 is arranged between a straight line connecting the ends of the first antenna element 21 and the second antenna element 22 in the direction Y1 and a straight line connecting the ends of the first antenna element 21 and the second antenna element 22 in the direction Y2. The first opposing portion 231 is spaced apart a distance enabling an electrostatic coupling to the first antenna element 21 therefrom. The second opposing portion 232 is spaced apart a distance enabling an electrostatic coupling to the second antenna element 22 therefrom.

The coupling portion 233 is arranged to couple ends of the first opposing portion 231 and the second opposing portion 232 in the direction Y1 with each other. The coupling portion 233 is formed to extend along arrow X.

The remaining structure of the second embodiment is similar to that of the aforementioned first embodiment.

As hereinabove described, also in the structure of the second embodiment, a mutual coupling between the antenna elements can be reduced while inhibiting reduction of flexibility of wiring pattern design, similarly to the aforementioned first embodiment. The mutual coupling between the antenna elements can be reduced, and hence it is not necessary to increase the distance between the antenna elements to reduce the mutual coupling between the antenna elements, and the multi-antenna apparatus 20 can be downsized accordingly. Consequently, the mobile phone 100 can be downsized.

According to the second embodiment, as hereinabove described, the first antenna element 21, the second antenna element 22, and the first opposing portion 231 and the second opposing portion 232 of the passive antenna element 23 are formed to be bent at the plurality of positions, whereby a length required to arrange the first antenna element 21, the second antenna element 22 and the passive antenna element 23 can be ensured due to bent shapes thereof also when areas where the first antenna element 21, the second antenna element 22 and the passive antenna element 23 are arranged are small, and hence it is not necessary to enlarge the areas where the first antenna element 21, the second antenna element 22 and the passive antenna element 23 are arranged. Thus, the multi-antenna apparatus can be downsized.

The remaining effects of the second embodiment are similar to those of the aforementioned first embodiment.

Next, results of a simulation performed for confirming the aforementioned effects of the second embodiment are described. In this simulation, the multi-antenna apparatus 20 corresponding to the second embodiment and the multi-antenna apparatus 110 according to the aforementioned comparative example shown in FIG. 3 have been compared with each other.

In the multi-antenna apparatus 20 corresponding to the second embodiment, the first antenna element 21 and the second antenna element 22 are so arranged that the minimum separate distance D3 is 14 mm less than λ/4. The antenna elements 21 and 22 and the passive antenna element 23 are provided on a surface of a glass epoxy substrate (not shown) having a thickness of 0.8 mm in the aforementioned second embodiment. In order to perform the simulation by a system corresponding to two dimensions, the antenna elements 21 and 22 and the passive antenna element 23 are formed of a conductor having a thickness of 0 mm.

Figure 7:
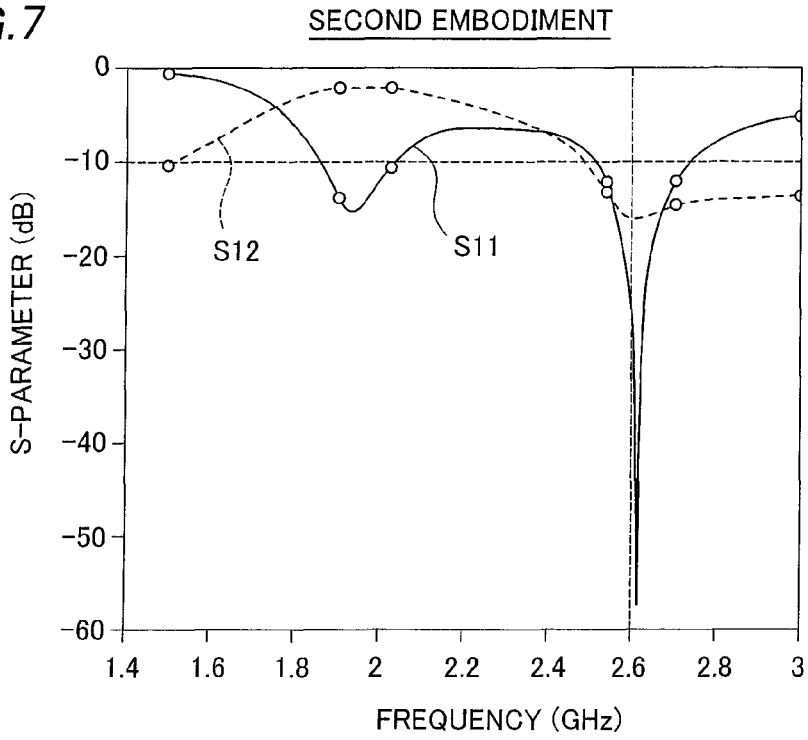
FIG. 7 is a diagram showing S-parameter characteristics of the multi-antenna apparatus corresponding to the second embodiment of the present invention in a simulation.

Next, S-parameter characteristics of the multi-antenna apparatus 110 according to the comparative example and the multi-antenna apparatus 20 corresponding to the second embodiment are described with reference to FIGS. 4 and 7.

As hereinabove described, in the multi-antenna apparatus 110 according to the comparative example, S11 is about −7 dB and S12 is about −5.8 dB at 2.6 GHz, as shown in FIG. 4. On the other hand, in the multi-antenna apparatus 20 corresponding to the second embodiment, S11 is about −16 dB and S12 is about −25 dB at 2.6 GHz to which the multi-antenna apparatus 20 corresponds, as shown in FIG. 7.

Consequently, S12 denoting strength of a mutual coupling between two antenna elements is smaller in the multi-antenna apparatus 20 corresponding to the second embodiment than in the multi-antenna apparatus 110 according to the comparative example, and hence it has been proved possible to reduce the mutual coupling between the antenna elements also when the first antenna element 21, the second antenna element 22, and the first opposing portion 231 and the second opposing portion 232 of the passive antenna element 23 are formed to be bent at the plurality of positions.

S11 denoting reflection coefficients of an antenna element is smaller in the multi-antenna apparatus 20 corresponding to the second embodiment than in the multi-antenna apparatus 110 according to the comparative example, and hence it has been proved possible to output radio waves efficiently from the antenna elements also when the first antenna element 21, the second antenna element 22, and the first opposing portion 231 and the second opposing portion 232 of the passive antenna element 23 are formed to be bent at the plurality of positions.

Further, it has been proved possible to render both values of S11 and S12 smaller in the multi-antenna apparatus 20 than in the multi-antenna apparatus 10 corresponding to the first embodiment while further downsizing the multi-antenna apparatus 20 by forming the first antenna element 21, the second antenna element 22 and the passive antenna element 23 to be bent, compared to the multi-antenna apparatus 10 corresponding to the first embodiment.

Third Embodiment

A multi-antenna apparatus 30 of a mobile phone 100 according to a third embodiment of the present invention is now described with reference to FIGS. 8 and 9. In this third embodiment, the multi-antenna apparatus 30 including a first matching circuit 31 arranged between a first antenna element 11 and a first feeding point 15 and a second matching circuit 32 arranged between a second antenna element 12 and a second feeding point 16 is described, dissimilarly to the aforementioned first embodiment.

Figure 8:
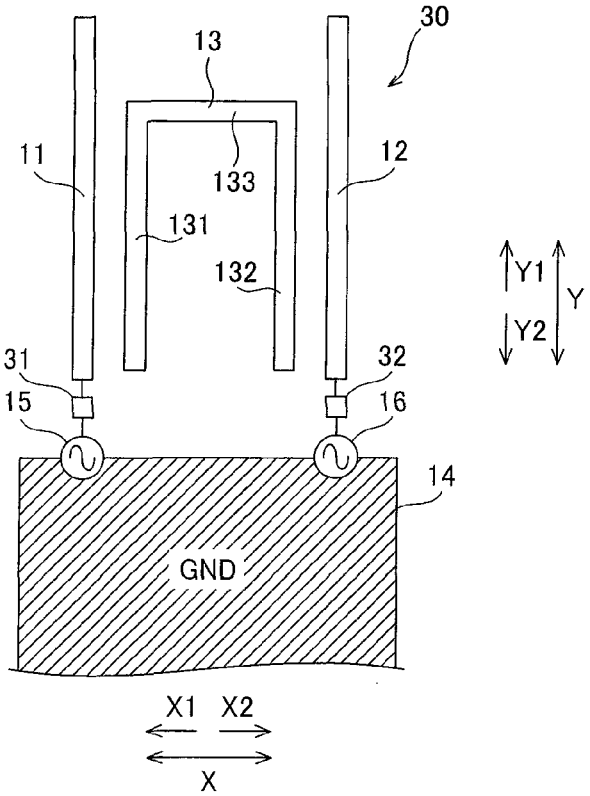
FIG. 8 is a plan view showing a multi-antenna apparatus of a mobile phone according to a third embodiment of the present invention.
Figure 9:
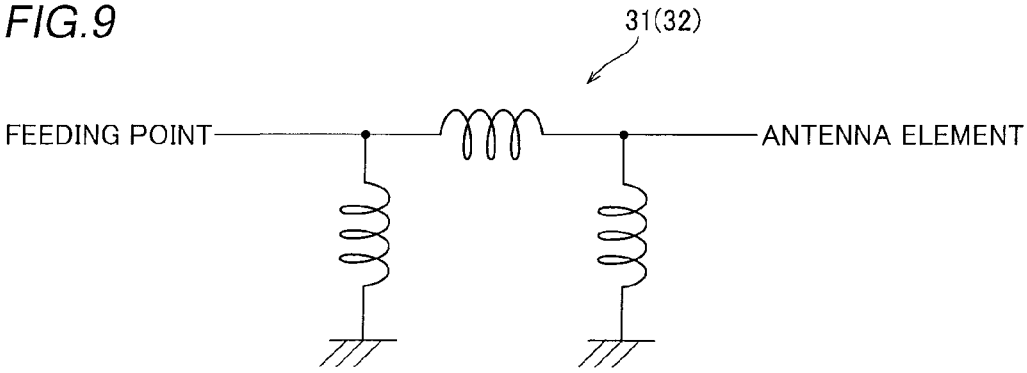
FIG. 9 is a diagram showing a matching circuit of the multi-antenna apparatus of the mobile phone according to the third embodiment of the present invention.

The multi-antenna apparatus 30 of the mobile phone 100 according to the third embodiment includes the first matching circuit 31 arranged between the first antenna element 11 and the first feeding point 15 and the second matching circuit 32 arranged between the second antenna element 12 and the second feeding point 16, as shown in FIG. 8.

The first matching circuit 31 (second matching circuit 32) has a function of reducing transfer loss of energy by impedance matching at 2.6 GHz to which the multi-antenna apparatus 30 corresponds. The first matching circuit 31 (second matching circuit 32) is provided for inhibiting a mutual coupling between the antenna elements while matching impedance at 2.6 GHz to which the multi-antenna apparatus 30 corresponds. More specifically, impedance of the first matching circuit 31 (second matching circuit 32) is adjusted, whereby a minimum value of S12 denoting strength of a mutual coupling between two antenna elements can be easily located in the vicinity of a desired frequency. The first matching circuit 31 (second matching circuit 32) is constituted by a it circuit (n match) made of an inductor (coil), as shown in FIG. 9.

The remaining structure of the third embodiment is similar to that of the aforementioned first embodiment.

As hereinabove described, also in the structure of the third embodiment, the mutual coupling between the antenna elements can be reduced while inhibiting reduction of flexibility of wiring pattern design, similarly to the aforementioned first embodiment. The mutual coupling between the antenna elements can be reduced, and hence it is not necessary to increase a distance between the antenna elements to reduce the mutual coupling between the antenna elements, and the multi-antenna apparatus 30 can be downsized accordingly. Consequently, the mobile phone 100 can be downsized.

According to the third embodiment, as hereinabove described, the first matching circuit 31 arranged between the first antenna element 11 and the first feeding point 15 for inhibiting the mutual coupling between the first antenna element 11 and the second antenna element 12 while matching impedance at a prescribed frequency of high-frequency power and the second matching circuit 32 arranged between the second antenna element 12 and the second feeding point 16 for inhibiting the mutual coupling between the first antenna element 11 and the second antenna element 12 while matching impedance at the prescribed frequency of the high-frequency power are provided, whereby the mutual coupling between the antenna elements can be reduced while matching impedance at the prescribed frequency, and hence transfer loss of energy transferred through the antenna elements can be further reduced.

The remaining effects of the third embodiment are similar to those of the aforementioned first embodiment.

Although the present invention has been described and illustrated in detail, it is clearly understood that the same is by way of illustration and example only and is not to be taken by way of limitation, the spirit and scope of the present invention being limited only by the terms of the appended claims.

For example, while the mobile phone is shown as an exemplary mobile device comprising a multi-antenna apparatus in each of the aforementioned first to third embodiments, the present invention is not restricted to this. The present invention is also applicable to another mobile device other than the mobile phone, such as a PDA (Personal Digital Assistant) or a small-sized notebook computer comprising a multi-antenna apparatus. Alternatively, the present invention is also applicable to another device, other than the mobile device, comprising a multi-antenna apparatus.

While the multi-antenna apparatus for MIMO communication is shown as an exemplary multi-antenna apparatus in each of the aforementioned first to third embodiments, the present invention is not restricted to this. In the present invention, a multi-antenna apparatus corresponding to another system other than MIMO, such as Diversity may be employed.

While the multi-antenna apparatus is formed to correspond to WiMAX of 2.5 GHz band in each of the aforementioned first to third embodiments, the present invention is not restricted to this. In the present invention, the multi-antenna apparatus may be formed to correspond to a frequency other than 2.5 GHz band or may be formed to correspond to another system other than WiMAX, such as GSM or 3G, for example.

While the two antenna elements are provided on the multi-antenna apparatus in each of the aforementioned first to third embodiments, the present invention is not restricted to this. In the present invention, more than two antenna elements may be provided so far as there are a plurality of antenna elements. In this case, a plurality of passive antenna elements may be provided.

Figure 10:
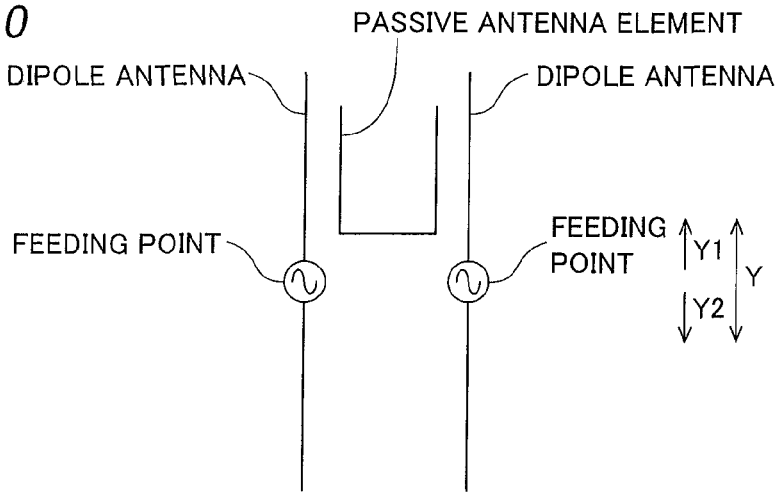
FIG. 10 schematically illustrates a multi-antenna apparatus constituted by a dipole antenna according to a modification of each of the first to third embodiments of the present invention.
Figure 11:
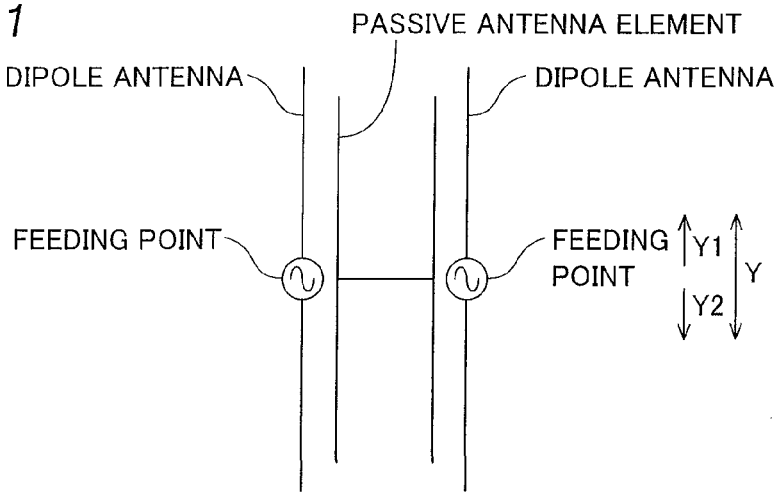
FIG. 11 schematically illustrates a multi-antenna apparatus constituted by a dipole antenna according to a modification of each of the first to third embodiments of the present invention.

While the first antenna element (second antenna element) constituted by a monopole antenna is shown as an exemplary first antenna element (second antenna element) in each of the aforementioned first to third embodiments, the present invention is not restricted to this. In the present invention, a first antenna element (second antenna element) other than a monopole antenna, such as a dipole antenna may be employed. For example, as shown in FIG. 10, a substantially U-shaped ungrounded passive antenna element may be so provided as to correspond to a portion closer to a side of a direction Y1 than a feeding point of a first antenna element (second antenna element) in a case of the first antenna element (second antenna element) constituted by a dipole antenna. Alternatively, as shown in FIG. 11, a substantially H-shaped ungrounded passive antenna element may be so provided as to correspond to both a portion closer to a side of a direction Y1 and a portion closer to a side of a direction Y2 than a feeding point of a first antenna element (second antenna element) constituted by a dipole antenna.

While the coupling portion of the passive antenna element couples the ends of the first and second opposing portions in the direction Y1 with each other in each of the aforementioned first to third embodiments, the present invention is not restricted to this. In the present invention, a coupling portion of the passive antenna element may couple ends of the first and second opposing portions in the direction Y2 or a coupling portion may couple another parts of the first and second opposing portions other than the ends thereof, so far as currents in opposite directions flow in the first and second opposing portions.

Figure 12:
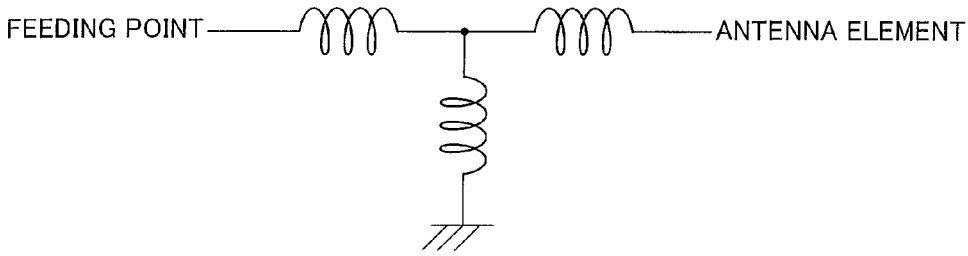
FIG. 12 schematically illustrates a T matching circuit according to a modification of the third embodiment of the present invention.
Figure 13:
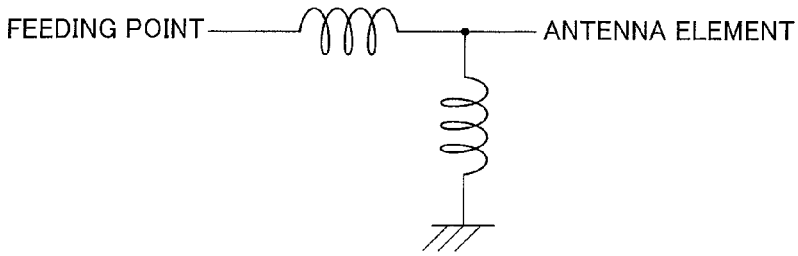
FIG. 13 schematically illustrates an L matching circuit according to a modification of the third embodiment of the present invention.

While the first matching circuit (second matching circuit) constituted by the π circuit (π match) made of an inductor (coil) is provided in the aforementioned third embodiment, the present invention is not restricted to this. In the present invention, a first matching circuit (second matching circuit) formed in another shape other than the π circuit, such as a T circuit (T match) made of an inductor (coil) shown in FIG. 12 or an L circuit (L match) made of an inductor (coil) shown in FIG. 13 may be provided. Alternatively, the π circuits, the T circuits, the L circuits or the like may be made of only either an inductor (coil) or a capacitor (condenser) or may be made of both an inductor (coil) and a capacitor (condenser).

While the first antenna element, the second antenna element, and the first and second opposing portions of the passive antenna element are formed to be bent at the plurality of positions in the aforementioned second embodiment, the present invention is not restricted to this. In the present invention, the first antenna element, the second antenna element, and the first and second opposing portions may be formed to be curved at a plurality of positions.

While the first antenna element, the second antenna element, and the first and second opposing portions of the passive antenna element are formed to extend along arrow Y in the aforementioned first and third embodiments, the present invention is not restricted to this. In the present invention, parts of the first antenna element, the second antenna element, and the first and second opposing portions may be formed to be bent or curved at a prescribed position.

While the coupling portion of the passive antenna element is formed to extend along arrow X in the aforementioned first to third embodiments, the present invention is not restricted to this. In the present invention, the coupling portion may be formed to be bent or curved at a prescribed position.

What is claimed is:

1. A multi-antenna apparatus comprising:

a first antenna element and a second antenna element; and an ungrounded passive antenna element sandwiched between said first antenna element and said second antenna element, wherein said passive antenna element includes a first opposing portion opposed to said first antenna element, a second opposing portion opposed to said second antenna element and a coupling portion coupling said first opposing portion and said second opposing portion with each other, wherein said coupling portion of said passive antenna element is formed to couple said first opposing portion and said second opposing portion with each other such that currents in opposite directions flow in said first opposing portion and said second opposing portion.

2. The multi-antenna apparatus according to claim 1, wherein said first opposing portion and said second opposing portion of said passive antenna element are spaced apart distances enabling electrostatic couplings to said first antenna element and said second antenna element therefrom, respectively.

3. The multi-antenna apparatus according to claim 1, wherein said passive antenna element is formed to resonate due to currents flowing in said first antenna element and said second antenna element.

4. The multi-antenna apparatus according to claim 3, wherein said passive antenna element has an electrical length of substantially one half of a wavelength λ of a radio wave output from each of said first antenna element and said second antenna element.

5. The multi-antenna apparatus according to claim 1, wherein said first antenna element is so arranged that a minimum separate distance from said second antenna element is less than a quarter of a wavelength λ of a radio wave output from each of said first antenna element and said second antenna element.

6. The multi-antenna apparatus according to claim 5, further comprising:

a first feeding point for supplying high-frequency power to said first antenna element; and a second feeding point for supplying high-frequency power to said second antenna element, wherein said first antenna element and said second antenna element are so arranged that a distance therebetween is minimum between said first feeding point and said second feeding point.

7. The multi-antenna apparatus according to claim 1, further comprising:

a first feeding point for supplying high-frequency power to said first antenna element and a second feeding point for supplying high-frequency power to said second antenna element;

a first matching circuit arranged between said first antenna element and said first feeding point for inhibiting a mutual coupling between said first antenna element and said second antenna element while matching impedance at a prescribed frequency of high-frequency power; and a second matching circuit arranged between said second antenna element and said second feeding point for inhibiting the mutual coupling between said first antenna element and said second antenna element while matching impedance at the prescribed frequency of high-frequency power.

8. The multi-antenna apparatus according to claim 1, wherein said passive antenna element is formed in a substantially U shape by said first opposing portion, said second opposing portion and said coupling portion.

9. The multi-antenna apparatus according to claim 1, wherein said first antenna element, said second antenna element, and said first opposing portion and said second opposing portion of said passive antenna element are formed to be bent or curved at a plurality of positions.

10. The multi-antenna apparatus according to claim 1, wherein said first antenna element and said second antenna element each include a monopole antenna.

11. The multi-antenna apparatus according to claim 1, wherein said first antenna element and said second antenna element each include a dipole antenna.

12. The multi-antenna apparatus according to claim 1, wherein said first antenna element, said second antenna element, and said first opposing portion and said second opposing portion of said passive antenna element are arranged substantially parallel to each other.

13. The multi-antenna apparatus according to claim 1, wherein:

said ungrounded passive antenna element is arranged between said first antenna element and said second antenna element such that said ungrounded passive antenna element does not protrude from a region spanning between the portions of said first antenna element and said second antenna element that oppose each other.

14. The multi-antenna apparatus according to claim 1, formed to be mountable on a mobile device.

15. A mobile device comprising a multi-antenna apparatus including a first antenna element and a second antenna element, and an ungrounded passive antenna element sandwiched between said first antenna element and said second antenna element, wherein said passive antenna element has a first opposing portion opposed to said first antenna element, a second opposing portion opposed to said second antenna element and a coupling portion coupling said first opposing portion and said second opposing portion with each other; wherein said coupling portion of said passive antenna element is formed to couple said first opposing portion and said second opposing portion with each other such that currents in opposite directions flow in said first opposing portion and said second opposing portion.

16. The mobile device according to claim 15, wherein said first opposing portion and said second opposing portion of said passive antenna element are spaced apart distances enabling electrostatic couplings to said first antenna element and said second antenna element therefrom, respectively.

17. The mobile device according to claim 15, wherein said passive antenna element has an electrical length of substantially one half of a wavelength $\lambda$ of a radio wave output from each of said first antenna element and said second antenna element.

18. The mobile device according to claim 15, wherein said first antenna element is so arranged that a minimum separate distance from said second antenna element is less than a quarter of a wavelength $\lambda$ of a radio wave output from each of said first antenna element and said second antenna element.

* * * * *